US009458641B2

(12) United States Patent
Harlow

(10) Patent No.: US 9,458,641 B2
(45) Date of Patent: Oct. 4, 2016

(54) DECONTAMINATION SHELTERS WITH INTEGRATED BALLAST SYSTEMS

(71) Applicant: Air Cruisers Company, LLC, Wall Township, NJ (US)

(72) Inventor: Andrew Mahlon Harlow, Brick, NJ (US)

(73) Assignee: Air Cruisers Company, LLC, Wall Township, NJ (US)

( * ) Notice: Subject to any disclaimer, the term of this patent is extended or adjusted under 35 U.S.C. 154(b) by 0 days.

(21) Appl. No.: 14/620,415

(22) Filed: Feb. 12, 2015

(65) Prior Publication Data

US 2015/0267425 A1 Sep. 24, 2015

Related U.S. Application Data

(60) Provisional application No. 61/955,889, filed on Mar. 20, 2014.

(51) Int. Cl.
*E04H 1/12* (2006.01)

(52) U.S. Cl.
CPC ..... *E04H 1/1277* (2013.01); *Y10S 4/90* (2013.01)

(58) Field of Classification Search
CPC ..... E04H 12/20; E04H 2015/201; E04H 2015/206; E04H 15/22; E04H 1/1277; Y10S 4/90; A47K 3/32
USPC ..... 52/2.11, 2.17, 2.18, 2.22, 2.23, 742.1, 52/742.13; 446/89; 4/900, 599
See application file for complete search history.

(56) References Cited

U.S. PATENT DOCUMENTS

| | | | | |
|---|---|---|---|---|
| 2,762,387 | A * | 9/1956 | Orwin | 137/360 |
| 3,629,875 | A * | 12/1971 | Dow et al. | 4/599 |
| 4,539,720 | A * | 9/1985 | Westerweller | 4/599 |
| 4,800,597 | A | 1/1989 | Healey | |
| 5,311,620 | A * | 5/1994 | Ratje | 4/599 |
| 5,416,933 | A * | 5/1995 | Bernard | 4/599 |
| 5,480,336 | A * | 1/1996 | Blanchard | 446/89 |
| 5,761,852 | A * | 6/1998 | Liu | 52/2.18 |
| 5,820,472 | A * | 10/1998 | Briggs | 472/128 |
| 5,987,822 | A * | 11/1999 | McNiff et al. | 52/2.11 |
| 6,047,729 | A * | 4/2000 | Hollister et al. | 137/557 |
| 6,050,872 | A * | 4/2000 | Cahill et al. | 446/89 |
| 6,192,633 | B1 * | 2/2001 | Hilbert | 52/2.18 |
| 6,260,306 | B1 * | 7/2001 | Swetish et al. | 52/2.18 |

(Continued)

*Primary Examiner* — Joshua J Michener
*Assistant Examiner* — Theodore Adamos
(74) *Attorney, Agent, or Firm* — Kilpatrick Townsend & Stockton LLP; Dean W. Russell

(57) ABSTRACT

Ballast systems for, particularly, inflatable decontamination shelters are described. The systems may be integrated into the overall structures of the shelters so as to avoid need for sand bags or other discrete weight-providing objects. They additionally may use liquids (rather than or in addition to solids) for weight-providing purposes, with the liquids including water supplied by the same plumbing system that supplies a shower of a shelter.

6 Claims, 2 Drawing Sheets

Decontamination Shelter with Integrated Ballast Tube Diagram

(56) References Cited

U.S. PATENT DOCUMENTS

| | | | | |
|---|---|---|---|---|
| 6,321,782 | B1 * | 11/2001 | Hollister | 137/557 |
| D460,790 | S * | 7/2002 | Moffett et al. | D21/506 |
| 6,935,073 | B2 * | 8/2005 | Scherba | 52/2.18 |
| 7,624,543 | B2 | 12/2009 | Sample et al. | |
| 7,946,307 | B2 * | 5/2011 | Zheng | 135/96 |
| 8,365,804 | B1 | 2/2013 | Genovese et al. | |
| 8,615,966 | B2 * | 12/2013 | Thompson | 52/745.19 |
| 2002/0083653 | A1 * | 7/2002 | Hilbert | 52/2.17 |
| 2004/0050411 | A1 * | 3/2004 | Lawrence | 135/128 |
| 2005/0284031 | A1 * | 12/2005 | Chen | 52/2.11 |
| 2007/0094937 | A1 * | 5/2007 | Pedretti | 52/2.11 |
| 2008/0268971 | A1 * | 10/2008 | Deasy et al. | 472/117 |
| 2010/0288320 | A1 * | 11/2010 | Rehkemper | 135/96 |
| 2012/0090248 | A1 * | 4/2012 | Thompson | A63H 33/008 52/2.18 |

* cited by examiner

Decontamination Shelter with Integrated Ballast Tube Diagram

Usable Area Example Layout with Integrated Ballast Tube System

DECONTAMINATION SHELTERS WITH INTEGRATED BALLAST SYSTEMS

CROSS-REFERENCE TO RELATED APPLICATION

This application claims the benefit of and priority to U.S. Provisional Patent Application Ser. No. 61/955,889, filed Mar. 20, 2014, entitled "Decontamination Shelter With Fully Integrated Ballast System," the entire contents of which are hereby incorporated herein by this reference.

FIELD OF THE INVENTION

This invention relates to ballast systems and more particularly, but not necessarily exclusively, to ballast systems for use in connection with, and integrated into, decontamination shelters.

BACKGROUND OF THE INVENTION

Decontamination shelters are increasingly in demand. Portable shelters are especially useful for "first responders" such as mobile medical crew and law enforcement officers as well as for military personnel and others working in the field (i.e. not in permanent institutional settings). Recent outbreaks of the Ebola virus in west Africa, for example, have highlighted need for equipment and structures useful to decontaminate medical workers treating infected populations.

U.S. Pat. No. 4,800,597 to Healey details a relatively simple decontamination shelter. As shown in the Healey patent, the shelter may include multiple adjacent compartments. One compartment may be designated a shower area and include a shower head. According to the Healey patent, "[t]he shelter desirably is comprised of flexible waterproof material and scaffolding in the form of hollow tubes with connecting fittings which can be erected to support the shelter and easily dismantled when the shelter has served its purpose." See Healey, col. 1, 11. 52-56. No inflation of any portion of the shelter occurs, however. Moreover, presumably because it employs substantial structure in the form of "tubular metal posts," see id., col. 3, 11. 17-19, the Healey patent fails to contemplate utilizing any ballast for stabilizing the shelter when constructed.

U.S. Pat. No. 7,624,543 to Sample, et al., discloses another decontamination shelter intended to be portable, "lightweight, and rapidly deployable." See Sample, col. 1, 11. 15-16. Preassembled, the shelter "comprises a frame movable between a stowed configuration and a deployed configuration and a canopy associated with the frame." See id., col. 1, 1. 66 to col. 2, 1. 1. As with the shelter of the Healey patent, those of the Sample patent are not inflated and have self-supporting frames including substantial structure in the form of multiple aluminum struts. See id., col. 4, 11. 4-8. Fabric straps or other "support elements" may be used "in cases where additional structural support is desired, such as . . . in windy conditions." See id., col. 4, 11. 24-61.

Finally, U.S. Pat. No. 8,365,804 to Genovese, et al., identifies a portion of yet another decontamination shelter. Designed "to form a gas-impermeable barrier in a structural location such as a hallway," see Genovese, Abstract, 11. 1-3, the device "is composed of an inflatable support section which contains two doorways separated by an inner compartment, and an outer, expandable bladder." See id., col. 1, 11. 48-50. Because intended for use within a structural location (i.e. indoors), the device is not subject to windy conditions or other destabilizing hazards and thus too lacks any ballast.

SUMMARY OF THE INVENTION

By contrast, shelters of the present invention are both inflatable and useful outdoors (as well as indoors). They further may be lightweight and capable of being stowed compactly. Shelters of the present invention nevertheless may function well in windy conditions and other potentially-destabilizing environments.

Versions of the invention may employ ballast to enhance their operating effectiveness in destabilizing conditions. Preferably, though, the ballast need not be in the form of sand bags or similar discrete weight-providing objects placed against or atop portions of a shelter. Instead, a ballast system may be integrated into the overall structure of the shelter. Moreover, the ballast may be liquid rather than a traditional solid (e.g. sand). Yet additionally, the liquid ballast may be or comprise water—including water supplied by the same source (and possibly by the same plumbing system) that supplies a shower of the shelter—thus avoiding need for any ballast material separate from that already available at the shelter.

Furthermore, by integrating the ballast system into the shelter structure, the volume of the ballast system may be incorporated within the footprint of the inflatable tube assembly of the shelter. This arrangement allows the ballast system to avoid consuming additional floor space either within or outside of the shelter, producing superior mobility for both operating crew and users of the shelter. Combined with the likely absence of any sand bags or other discrete objects, this arrangement also reduces risk of tripping hazards as well as damage to the ballast structures from foot traffic or related activities.

It thus is an optional, non-exclusive object of the present invention to provide ballast systems integrated into other structures.

It is also an option, non-exclusive object of the present invention to provide ballast systems for use in connection with decontamination shelters.

It is another optional, non-exclusive object of the present invention to provide systems utilizing ballast of the same type as employed for other purposes within the systems.

It is a further optional, non-exclusive object of the present invention to provide systems in which the ballast is or comprises water.

It is an additional optional, non-exclusive object of the present invention to provide ballast systems whose volume is incorporated within inflatable tube assemblies of decontamination shelters.

Other objects, features, and advantages of the present invention will be apparent to those skilled in the relevant art with reference to the remaining text and the drawings of this application.

DETAILED DESCRIPTION

Figure 1:
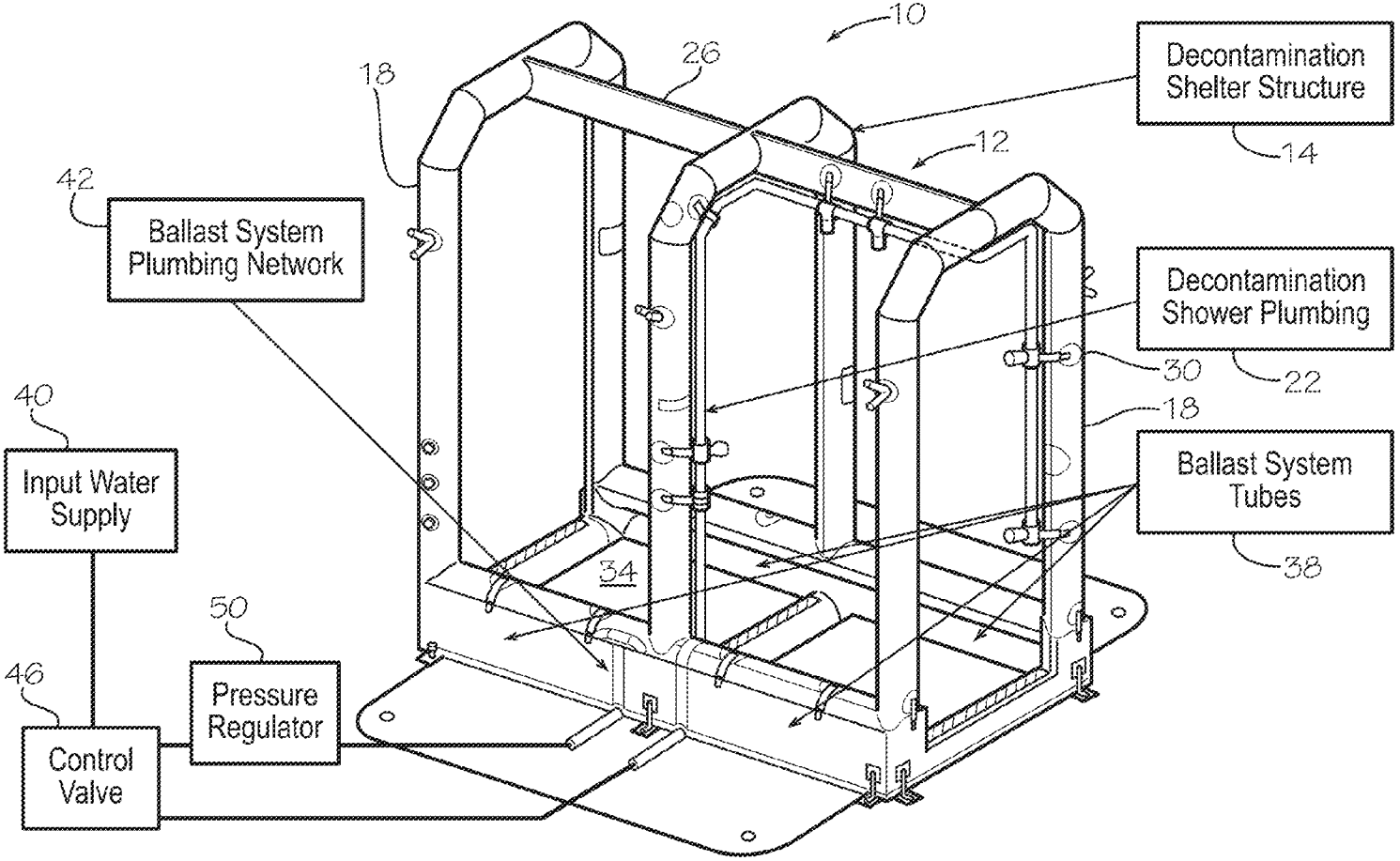
FIG. 1 is a perspective view of a portion of a decontamination shelter including a ballast system useful in connection with the present invention.

Depicted in FIG. 1 is a portion of an exemplary decontamination shelter 10 consistent with the present invention.

Shelter 10 may include three-dimensional structure 14 configured, when deployed, to bound volume sufficient for occupancy by at least one person. Preferably, shelter 10 includes a shower 12 and has height adequate for a person to stand underneath a nozzle or head of the shower 12. Structure 14 also preferably is covered, in part or whole, by material suitable to provide privacy for the user of shelter 10 and isolate the user from the environment surrounding shelter 10.

At least portions of structure 14 may be inflatable for use. FIG. 1 illustrates various support tubes 18 of structure 14 configured to receive inflation air or other gas. Tubes 18 may have any desired size and shape and may be formed of any suitable gas-impervious (or substantially so) material. Advantageously, tubes 18 are formed of light weight, pliable material that may be folded or otherwise collapsed into a smaller volume when uninflated.

Structure 14 additionally may include other components and equipment, some or all of which are not typically configured for inflation. Examples of such components and equipment shown in FIG. 1 comprise shower plumbing 22 and cross-support 26. Further examples may be attachment assemblies 30 by which plumbing 22 may be connected to tubes 18 for use as well as floor 34.

Figure 2:
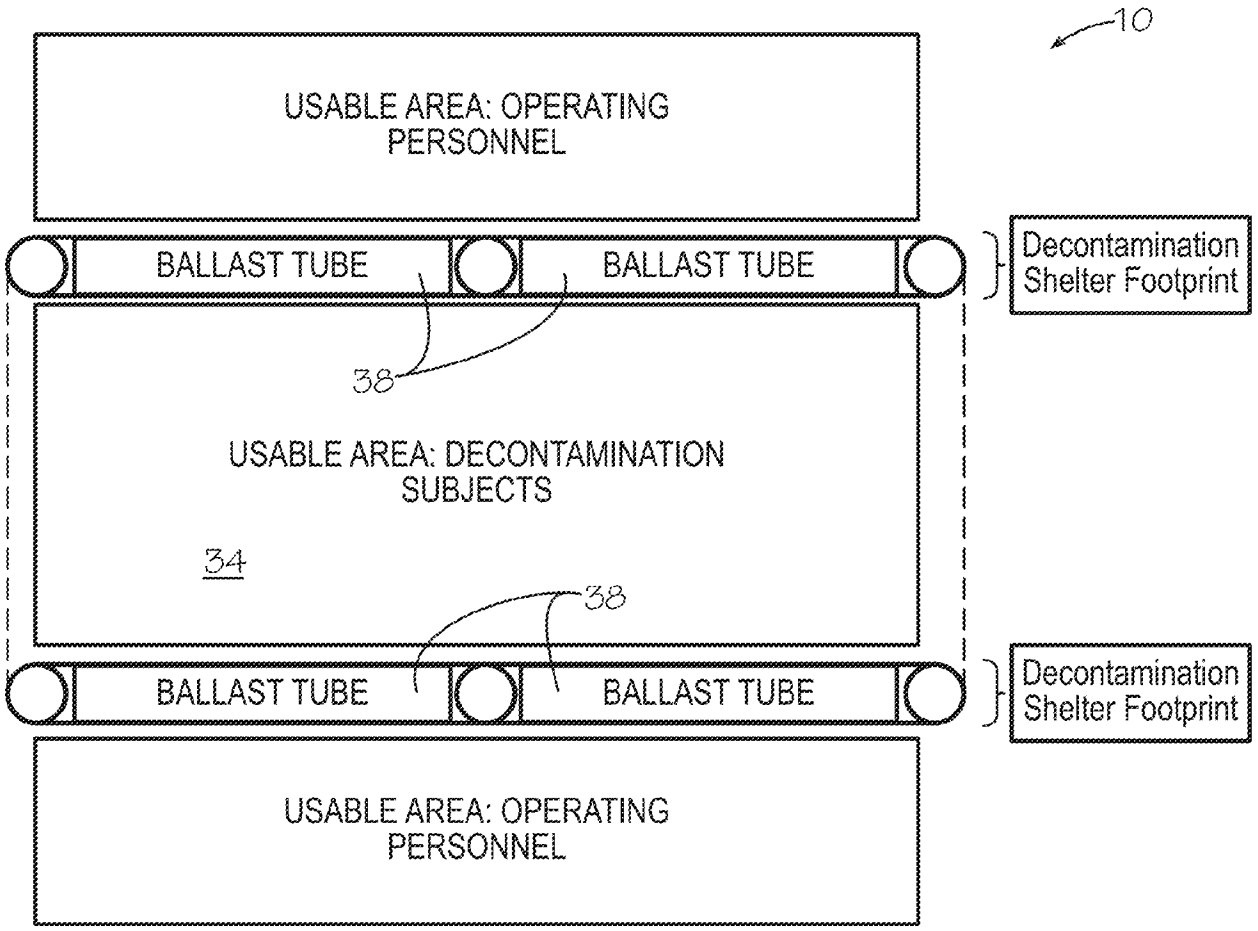
FIG. 2 is a schematized, plan view of, among other things, the footprint of the decontamination shelter of FIG. 1.

Further illustrated in FIGS. 1-2 is that structure 14 may comprise one or more ballast tubes 38. As with tubes 18, ballast tubes 38 may have any desired size and shape and beneficially may be formed of light weight, pliable material. Ballast tubes 38 may be integral with tubes 18 or other parts of structure 14; alternatively, ballast tubes 38 may be fastened or otherwise connected to one or more other components of the structure 14. Advantageously, though, ballast tubes 38 are constructed and placed so that, when not in use, they may fold or collapse into a smaller volume together with other parts of structure 14 for integrated storage.

Although ballast tubes 38 may, if desired, be constructed of gas-impervious material, they preferably are formed of material that is liquid-impervious (or substantially so). This is because ballast tubes 38 are configured to receive quantities of liquid in use, with the weight of the liquid serving as ballast for structure 10. A preferred ballast liquid is water, which if desired may derive from the same source 40 as supplies the shower 12 of shelter 10. In this case ballast plumbing 42 may provide liquid communication between source 40 and ballast tubes 38. Ballast plumbing 42 may either be wholly distinct from plumbing 22 or share some piping or other components.

As shown in FIG. 1, control valve 46 optionally may be interposed between source 40 and each of plumbing 22 and ballast plumbing 42. Interposing control valve 46 in this manner allows operating personnel or a user to direct flow of water from source 40 only to the shower 12, only to ballast tubes 38, or to both the shower 12 and ballast tubes 38. To reduce pressure of water flow from source 40 and consequent risk of damaging or overfilling ballast tubes 38, pressure regulator 50 optionally may be interposed between control valve 46 and ballast plumbing 42.

Additionally illustrated in FIGS. 1-2 is that ballast tubes 38 effectively form a base of structure 14 atop the ground or other surface on which shelter 10 is positioned. When deployed, structure 14 thus defines a footprint (see FIG. 2) with respect to such surface. Ballast tubes 38 need not extend this footprint of structure 14 beyond that which would otherwise be provided by tubes 18, nor do ballast tubes 38 subtract from the area of floor 34 available to operating personnel and users of shelter 10. These characteristics offer superior mobility of operating personnel and users both within and outside shelter 10 as reflected in FIG. 2. They also reduce risk of tripping hazards to humans and damage to the ballast itself as compared with using conventional sand bags or similar discrete objects.

By using common water source 40 to fill ballast tubes 38, no separate ballast fluid or solid is needed for the ballast tubes 38. Similarly, routing both plumbing 22 and ballast plumbing 42 to the same source 40 avoids need for separate reservoirs for the shower 12 and ballast fluid. Shelter 10 hence may be more quickly and easily constructed than are conventional decontamination shelters.

Shelter 10 may be deployed in any appropriate way for use. One exemplary deployment method includes transporting the shelter 10 to a suitable site and constructing structure 14 at least by inflating support tubes 18 and attaching plumbing 22 thereto. Also as part of the construction, plumbing 22 and ballast plumbing 42 may be connected directly or indirectly to source 40 and liquid from source 40 added to ballast tubes 38. Those skilled in the art will, of course, recognize that other actions may be required to construct structure 14 and render shelter 10 fully functional.

The foregoing is provided for purposes of illustrating, explaining, and describing embodiments of the present invention. Modifications and adaptations to these embodiments will be apparent to those skilled in the art and may be made without departing from the scope or spirit of the invention. Incorporated herein by this reference are the entire contents of the Healey, Sample, and Genovese patents.

What is claimed is:

1. A decontamination shelter comprising:

a. an inflatable structure for at least partially isolating a human from his or her environment and comprising (i) at least two ballast tubes, each comprising a chamber and extending substantially parallel with the other, (ii) at least two cross tubes, each comprising a chamber and extending substantially perpendicular to the at least two ballast tubes, (iii) at least one inflatable support tube to which at least one ballast tube is connected, and (iv) a shower, wherein the at least two ballast tubes each comprise either a height or a width greater than a respective height or width of each of the at least two cross tubes, and the chambers of each of the at least two ballast tubes are in communication with one another to allow liquid to travel within each chamber;

b. a liquid source communicating with (i) the at least two ballast tubes to supply ballast liquid thereto and (ii) the shower to supply shower liquid thereto;

c. ballast plumbing configured to communicate the ballast liquid from the liquid source to the at least two ballast tubes;

d. shower plumbing configured to communicate the shower liquid from the liquid source to the shower;

e. a control valve (i) interposed between the liquid source and each of the shower plumbing and the ballast plumbing and (ii) configured to supply both ballast liquid and shower liquid concurrently from the same source; and f. a pressure regulator (i) interposed between the control valve and at least one ballast tube and (ii) configured to reduce pressure of the ballast liquid below pressure of the shower liquid.

2. A decontamination shelter according to claim 1 in which the at least one inflatable support tube, the at least two ballast tubes, the ballast plumbing, and the shower plumbing are configured to collapse for storage together.

3. A decontamination shelter according to claim 2 in which the at least one inflatable support tube, the at least two ballast tubes, the ballast plumbing, and the shower plumbing are configured to collapse without disassembly for integrated storage together.

4. A decontamination shelter according to claim 1 in which, when the shower is in use, the ballast liquid communicated to the at least two ballast tubes by the ballast plumbing is not flowing through the at least two ballast tubes.

5. A decontamination shelter comprising:

a. an inflatable structure for at least partially isolating a human from his or her environment and comprising (i) at least two ballast tubes, each comprising a chamber and extending substantially parallel with the other, (ii) at least two cross tubes, each comprising a chamber and extending substantially perpendicular to the at least two ballast tubes, (iii) at least one inflatable support tube to which at least one ballast tube is connected, and (iv) a shower, wherein the at least two ballast tubes each comprise either a height or a width greater than a respective height or width of each of the at least two cross tubes, and the chambers of each of the at least two ballast tubes are in communication with one another to allow liquid to travel within each chamber;

b. a liquid source communicating with (i) the at least two ballast tubes to supply ballast liquid thereto and (ii) the shower to supply shower liquid thereto;

c. ballast plumbing configured to communicate the ballast liquid from the liquid source to the at least two ballast tubes;

d. shower plumbing configured to communicate the shower liquid from the liquid source to the shower; and e. a floor, wherein the at least one inflatable support tube comprises a plurality of inflatable support tubes (i) extending generally vertically above the floor and (ii) defining a footprint of the inflatable structure, and at least one ballast tube is positioned within the footprint and bounds at least a portion of the floor.

6. A decontamination shelter according to claim 5 in which at least a portion of the floor is not bounded by the at least two ballast tubes.

* * * * *